US006520253B2

(12) United States Patent
Calder

(10) Patent No.: US 6,520,253 B2
(45) Date of Patent: Feb. 18, 2003

(54) ROTATING DRILLING HEAD SYSTEM WITH STATIC SEALS

(75) Inventor: Ian Douglas Calder, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/848,647

(22) Filed: May 3, 2001

(65) Prior Publication Data

US 2001/0047885 A1 Dec. 6, 2001

Related U.S. Application Data

(60) Provisional application No. 60/202,575, filed on May 10, 2000.

(51) Int. Cl.[7] ..... E21B 3/04
(52) U.S. Cl. ..... 166/84.4; 166/84.2; 175/195
(58) Field of Search ..... 175/195; 166/84.2, 166/84.3, 84.4; 277/326, 332

(56) References Cited

U.S. PATENT DOCUMENTS

| | | | | |
|---|---|---|---|---|
| 4,480,703 A | * | 11/1984 | Garrett | 175/195 |
| 4,928,769 A | | 5/1990 | Milberger et al. | |
| 4,969,516 A | | 11/1990 | Henderson et al. | |
| 5,044,442 A | | 9/1991 | Nobileau | |
| 5,465,794 A | | 11/1995 | McConaughy et al. | |
| 5,555,935 A | | 9/1996 | Brammer et al. | |
| 5,588,491 A | * | 12/1996 | Brugman et al. | 166/383 |
| 5,791,411 A | | 8/1998 | Ricalton et al. | 166/84.1 |
| 5,865,250 A | | 2/1999 | Gariepy | |
| 6,016,880 A | | 1/2000 | Hall et al. | |
| 6,109,348 A | * | 8/2000 | Caraway | 166/84.3 |
| 6,129,152 A | * | 10/2000 | Hosie et al. | 166/384 |

FOREIGN PATENT DOCUMENTS

| | | |
|---|---|---|
| WO | WO 99/49177 A1 | 9/1999 |
| WO | WO 99/51852 A1 | 10/1999 |

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A rotatable head assembly wherein there is an outer housing that carries a cartridge assembly that permits rotational movement. The cartridge assembly made up of a cartridge housing and cartridge body that is rotatable within the cartridge housing. Static seals are used to provide fluid seals between the radially outer surface of the cartridge housing and the outer housing. Fluid passages within the cartridge housing carry lubricating fluid from the static seals to dynamic seals that allow the cartridge body to rotate easily within the cartridge housing. Fluid passages are also provided within the cartridge housing for carrying spent fluid out through the cartridge housing. There may be multiple fluid inlets and outlets within the cartridge housing without requiring a multiplicity of stepped increases in the diameter of the cartridge housing and the outer housing. Instead, the inlets and outlets are angularly spaced about the circumference of the cartridge, and each of the fluid passages extends axially through the cartridge housing to a different axial position, or elevation, along the body of the cartridge housing. The static seals also provide resilient and lasting fluid sealing.

19 Claims, 3 Drawing Sheets

ROTATING DRILLING HEAD SYSTEM WITH STATIC SEALS

CROSS-REFERENCE TO RELATED APPLICATIONS

This application claims the benefit of U.S. Provisional patent application Ser. No. 60/202,575 filed May 10, 2000.

BACKGROUND OF THE INVENTION

1. Field of the Invention

The present invention relates generally to head assemblies including rotating head systems and the like. In particular aspects, the invention relates to methods and devices for sealing a rotating drilling head or other device having a rotatable bearing against a drill pipe or other tubular member.

2. Description of the Related Art

Rotating drilling head systems use an elastomeric element to seal the drilling head against a drill pipe during drilling operations. One of such systems is described in U.S. Pat. No. 6,016,880, entitled "Rotating Drilling Head with Spaced Apart Seals," which has been assigned to the assignee of the present invention. That patent is incorporated herein by reference. Rotating drilling head arrangements typically use a cartridge unit that can be readily installed and removed from a housing for replacement of the elastomeric elements.

The cartridge unit for the system of the '880 patent is landed within a housing that contains several laterally oriented fluid flow ports through which lubricating fluid is pumped. The fluid ports on the housing are aligned with complimentary ports in the cartridge unit to form complete flow paths. The flow ports are sealed from one another using smaller diameter seals, each concentric with one of the flow ports. Unfortunately, if small diameter seals are used, they wear out quickly as replacements of the cartridge occur.

Gallery seals work better than the small diameter elastomeric seals. However, to work properly, there must be stepped increases in the diameter of the main housing within which the cartridge unit resides. Too many of these diameter increases result in the cartridge unit being too large at the upper end, thereby requiring a larger main housing, which may be impractical. A cartridge unit and drilling string of smaller diameter can be used instead. However, this is generally considered to be undesirable as drilling productivity is reduced.

The present invention addresses the problems of the prior art.

SUMMARY OF THE INVENTION

The invention relates generally to head assemblies and like devices wherein there is an outer housing that carries a cartridge assembly that permits rotational movement. In particular aspects, the invention provides techniques for establishing an improved seal between the outer housing and the cartridge assembly. Additionally, the invention provides techniques for improved lubrication of the bearings used within the cartridge assembly. An exemplary rotating drilling head assembly is described that is representative of this type a head assembly and includes a cartridge assembly made up of a cartridge housing and cartridge body that is rotatable within the cartridge housing. In the preferred embodiment described, static seals are used to provide fluid seals between the radially outer surface of the cartridge housing and the outer housing. On or more fluid passages within the cartridge housing carry lubricating fluid from the static seals to dynamic seals that allow the cartridge body to rotate easily within the cartridge housing. One or more fluid passages and static seals are also provided so that spent fluid may be removed through the cartridge housing.

The static seal arrangement of the present invention is advantageous, as compared to prior art techniques for providing sealing in these types of head assemblies. For example, there may be multiple fluid inlets and outlets within the cartridge housing without requiring a multiplicity of stepped increases in the diameter of the cartridge housing and the outer housing. Instead, the inlets and outlets are angularly spaced about the circumference of the cartridge, and the fluid passages extend axially through the cartridge housing to a different axial position, or elevation, along the body of the cartridge housing. The static seals also provide resilient and lasting fluid sealing.

DETAILED DESCRIPTION OF THE PREFERRED EMBODIMENTS

The devices and methods of the present invention are applicable generally to head assemblies wherein an outer, generally cylindrical housing retains a cartridge assembly that provides for rotational motion. The cartridge assemblies in such devices typically include a stationary outer cartridge sleeve and an inner body that is rotatably mounted within the cartridge housing. Lubrication is used to permit ease of rotation for the cartridge body within the cartridge housing.

Figure 1A:
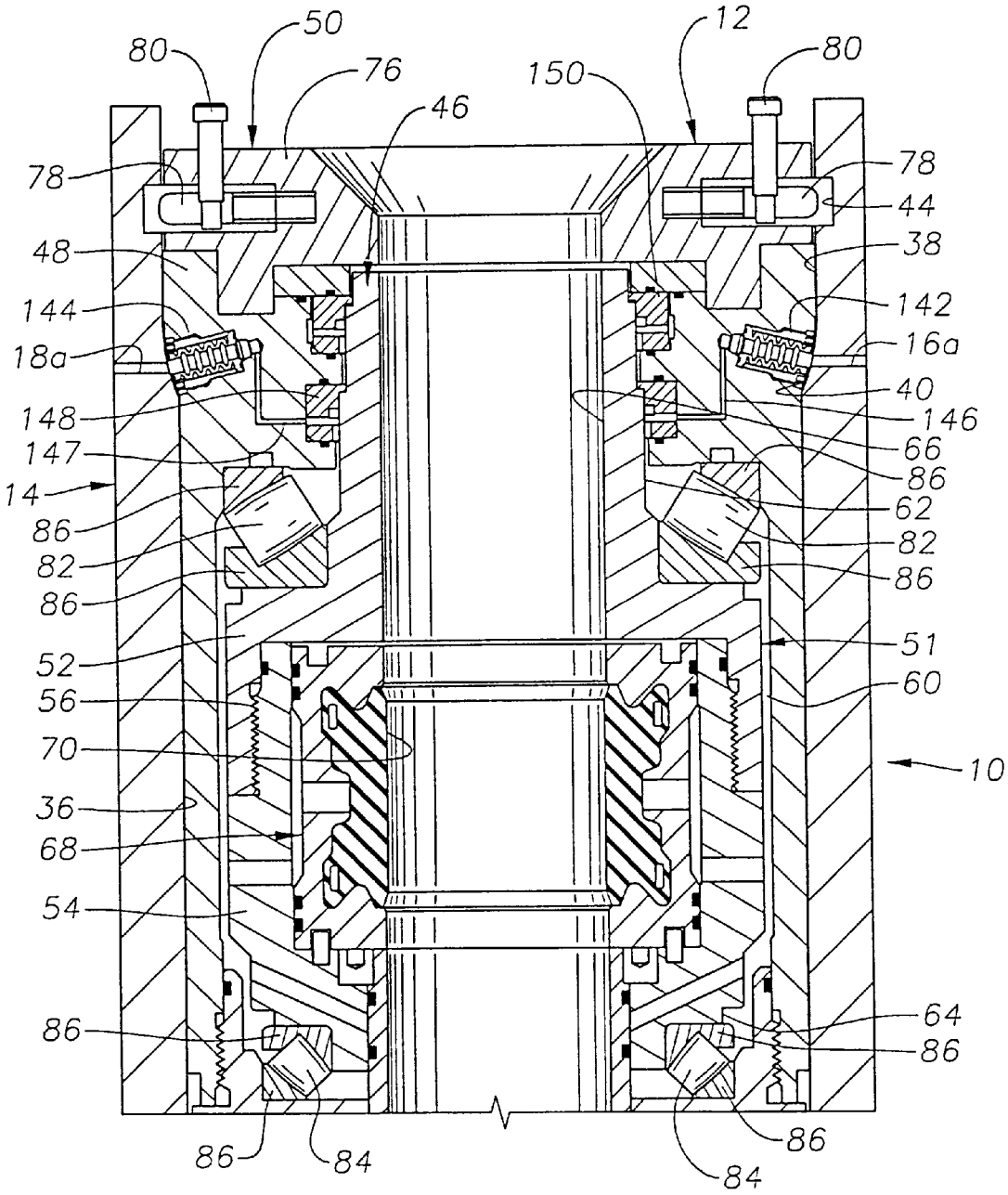
FIGS. 1A and 1B are a cross-sectional side view of an exemplary rotating drilling head assembly constructed in accordance with the present invention.
Figure 1B:
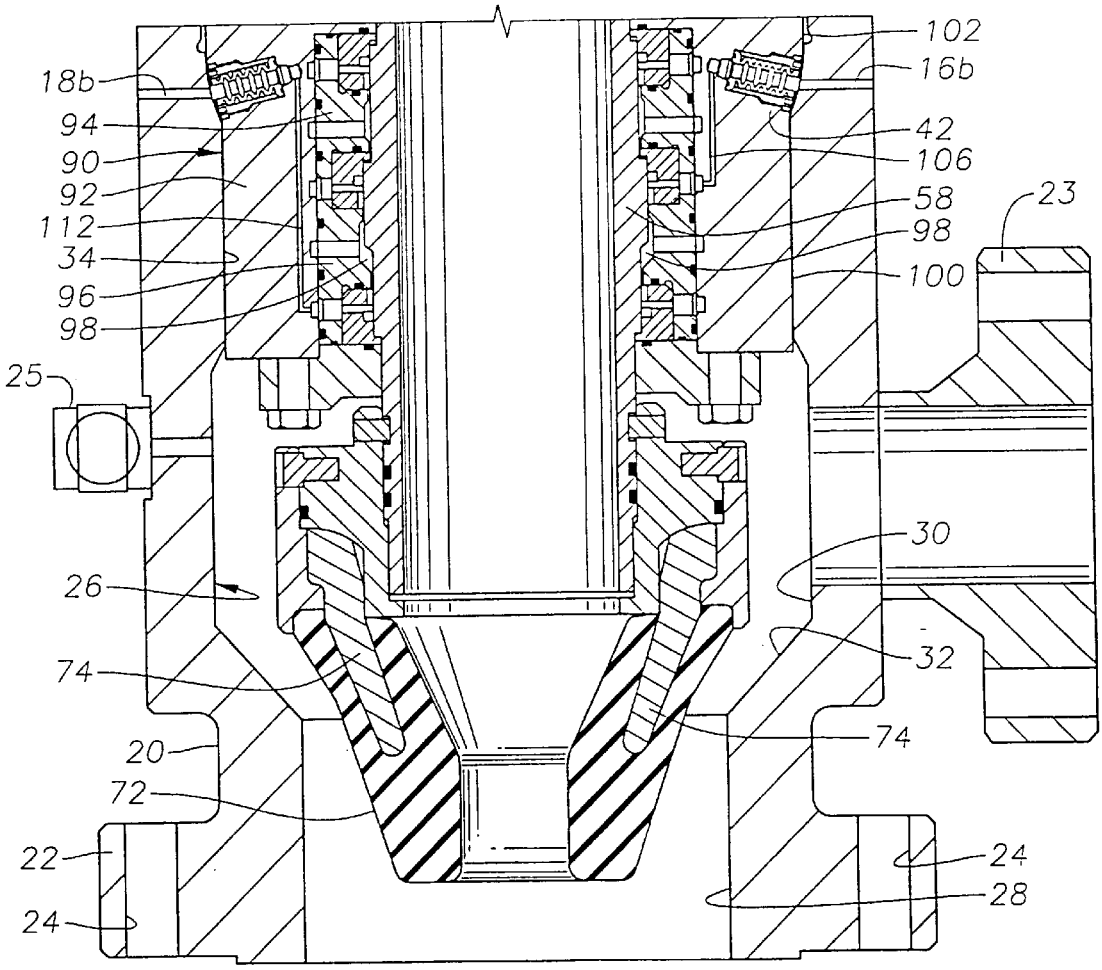

FIGS. 1A and 1B depict an exemplary rotating drilling head arrangement 10 that is representative of head assemblies of the type mentioned above. The drilling head arrangement 10 includes a cartridge assembly 12 that is shown seated in a main housing 14. The main housing 14 is typically mounted below the rig floor (not shown). The drilling head 10 is used in conjunction with drill pipe (not shown) having a plurality of tool joints. The tool joints are the threaded connector portions of each section of pipe and have enlarged outer diameters over the remaining portion of the pipe.

The main housing 14 is generally cylindrical in shape. Proximate its upper end, the main housing 14 has two fluid inlet ports 16*a* (one shown) and two fluid outlet ports 18*a* (one shown). Further down along the length of the main housing 14 are three fluid inlet ports 16*b* (one shown) and two fluid outlet ports 18*b* (one shown) that pass through the housing 14. The lower end of the main housing 14 has an annular groove 20 located above an outwardly protruding annular flange 22. Apertures 24 are disposed through the flange 22 so that connectors (not shown) may be passed through the flange 22 to connect the main housing 14 to other components such as a mud sleeve. A mud outlet 23 and pressure sensor 25 are also depicted. During drilling, drilling mud flows upward through the lower portion 28 of the inner bore 26 and outward through the mud outlet 23.

Figure 3:
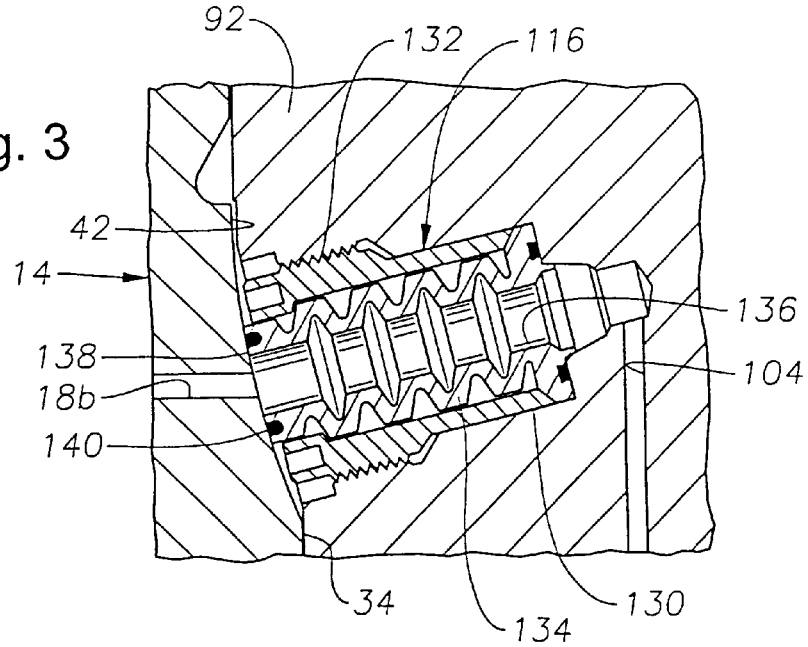
FIG. 3 is a detail cross-sectional view illustrating an exemplary static seal.

The main housing 14 has an inner bore 26 within which the cartridge assembly 12 is removably seated. The inner bore 26 provides a lower portion 28 having a reduced diameter and an enlarged diameter portion 30 just above that. An upward and inward facing shoulder 32 is defined between those two portions. The inner bore 26 also includes three staged bore portions 34, 36 and 38 that present successive increases in diameter as the upper end of the main housing 14 is approached. Curved shoulders 40, 42 are defined at the intersections of these bore portions 34, 36 and 38. Each shoulder 40, 42 is a segment of a sphere. The structure of these shoulders is better appreciated with reference to FIG. 3 which shows shoulder 42 in close up. As FIG. 1 shows, an annular channel 44 is cut into the upper end of the bore 26. It is noted that the cartridge assembly 12 is removably seated in the main housing 14 and can be removed by pulling up on the cartridge assembly 12.

The cartridge assembly 12 is made up of an inner, generally cylindrical cartridge body 46 and an outer cartridge housing 48 that radially surrounds the cartridge body 46. The cartridge body 46 is capable of rotation within the cartridge housing 48. The cartridge body 46 is retained within the cartridge housing 48 by a retaining ring assembly 50.

The cartridge body 46 has an upper mandrel 51 that is made up of an upper section 52 and a lower section 54 that are affixed to one another by a threaded connection 56. The lower section 54 is securely affixed to tubular body segment 58. The upper mandrel 51 has a radially enlarged central portion 60 with reduced diameter portions 62, 64 located above and below, respectively.

The cartridge body 46 defines a bore 66 that passes therethrough within which a drill string is disposed during drilling. The cartridge body 46 also retains an elastomeric gripping assembly 68 within the upper and lower sections 52, 54 of the upper mandrel 51. The elastomeric gripping assembly 68 includes a selectively energizable elastomeric element 70 that can be hydraulically energized to protrude radially inwardly. Portions of a drill string (not shown) that are disposed within the bore 66 may be gripped by the element 70 in an energized state so that the cartridge body 46 will rotate with the drill string during drilling.

The lower end of the tubular body segment 58 carries a conical elastomeric shroud 72 that has metal reinforcing members 74 within. The shroud 72 acts to grip portions of the drill string that pass through the tubular body segment 58. The shroud 72 also functions to prevent mud flowing upwardly through the lower part 28 of the bore 26 from entering the bore 66. It is noted that the radial inner surfaces of the cartridge housing 48 are shaped to accommodate the cartridge body 46 in a generally complimentary fashion.

The retaining ring assembly 50 includes a cylindrically-shaped ring body 76 that has a number of radially-outwardly spring-biased pins 78 retained about its periphery. The pins 78 are shaped and sized to fit within the groove 44 in the upper end of the main housing 14. Drawing handles 80 are used to selectively draw the pins 78 out of the groove 44 so that the ring body 76 can be removed from the upper end of the main housing 14 when necessary for maintenance or for replacement of parts.

There are a plurality of upper roller bearings 82 and lower roller bearings 84 that are disposed between hardened shoulders 86 on both the cartridge body 46 and the surrounding cartridge housing 48. The roller bearings 82, 84 maintain the cartridge body 46 a distance away from the cartridge housing 48 and roll on the hardened surface 86 to permit the cartridge body 46 to rotate with respect to the cartridge housing 48.

An annular dynamic seal assembly, shown generally at 90, surrounds the tubular body segment 58 of the cartridge body 46. The dynamic seal assembly 90 is stationarily mounted in housing 14 and seals against sleeve 58, which rotates with the drill pipe. The dynamic seal assembly 90 has an outer body 92 that contains metal dynamic seals 94, 96 that radially surround the tubular body segment 58. The dynamic seals 94, 96 are each annular members having a plurality of fluid apertures disposed radially therethrough. To properly act as seals, the dynamic seals 94, 96 require lubricant to constantly be pumped into the annular spaces 98 between the dynamic seals 94, 96 and the tubular body segment 58. Thus, they function to provide active lubrication that permits the cartridge body 46 to easily rotate within the cartridge housing 48.

Figure 2:
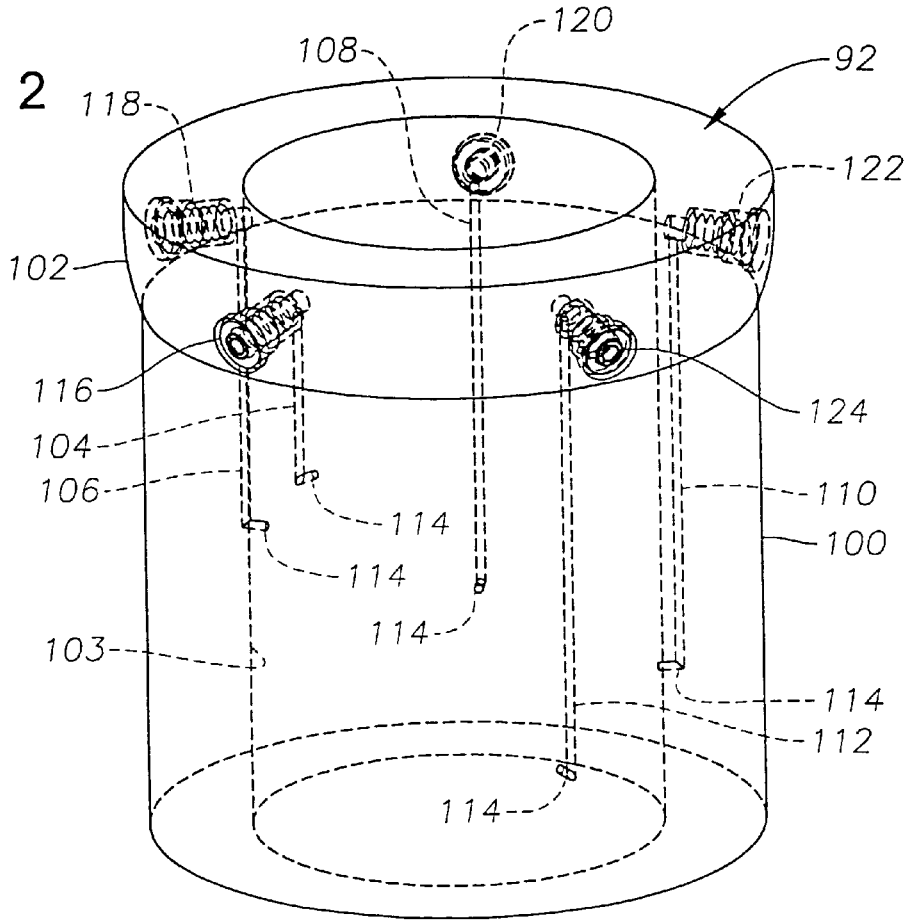
FIG. 2 is a schematic isometric view of the cartridge housing used in the drilling head assembly of FIG. 1 shown apart from the drilling head assembly.

The body 92 of the seal assembly 90 is schematically shown in FIG. 2 apart from the remainder of the drilling head arrangement 10. The body 92 has a substantially vertical and flat outer surface 100 along most of its length. There is, however, an upper, enlarged diameter portion 102, the radial outward surface of which is curved to be substantially complimentary to the curved shoulder 42 of the main housing 14. In addition, the body 92 defines a bore 103 along its entire length. The body 92 also contains five fluid passages 104, 106, 108, 110 and 112 that are depicted in phantom in FIG. 2. Each of the fluid passages 104, 106, 108, 110 and 112 has an inturned portion 114 at its lower end (see FIG. 2). The fluid passages 104, 106, 108, 110 and 112 each extend from the outer surface of the upper enlarged diameter portion 102 downwardly to a point along the bore 103 of the body 92. With reference to FIG. 2, it can be seen that each of the fluid passages is of a different length so that each communicates with the internal bore 103 at a different elevation along the body 92 of the dynamic seal assembly 90. It is also noted, with reference to FIG. 2, that the fluid passages 104, 106, 108, 110 and 112 are angularly spaced apart from one another about the circumference of the body 92.

Each of the fluid passages 104, 106, 108, 110 and 112 has, at its upper end, a static fluid seal 116, 118, 120, 122 and 124, respectively. As FIG. 2 shows, each static seal is located at approximately an equivalent lateral location upon the radial exterior of the cartridge housing body 92. Specifically, that lateral location coincides with the enlarged diameter portion 102 of the body 92. The construction and operation of the static fluid seals are best understood with reference to FIG. 3 where exemplary static seal 116 is shown in greater detail. The static seal 116 is of the type described in U.S. Pat. No. 5,555,935 entitled "Fluid Connector for Well" issued to Brammer et al. and assigned to the assignee of the present invention. That patent is incorporated herein by reference. Basically, the static seal 116 includes an outer cylindrical retainer 130 that is secured within the body 92 by a threaded connection 132. The retainer 130 radially surrounds a seal member 134 that defines a fluid pathway 136 to communicate fluid between the lower fluid port **18*b* and the fluid passage 104. The seal member 134 is axially compressible and presents a mating face 138 that carries an elastomeric seal 140 thereupon. When the radial body 92 is disposed within the main housing 14, the mating face 138 engages the shoulder 42 of the main housing 48 so that the fluid pathway 136 of the static seal 116 is aligned with the fluid port 18*b* in the main housing. The mating face 138 is urged against the shoulder 42 by the spring bias of the seal member 134**, thereby establishing a positive seal.

The three lower fluid inlet ports **16*b* mate with static seals 116, 118 and 120 and, via those, are connected with fluid passages 104, 106 and 108 respectively. The two lower fluid outlet ports 18***b* mate with static seals 122 and 124 and, via those, are connected with fluid passages 110 and 112.

The upper fluid passages 16*a*, 18*a* mate with static seals 142, 144 that are disposed within the upper end of the cartridge housing 48. Fluid passages 146, 147 pass through the cartridge housing 48 between the static seals 142, 144 and the metal dynamic seal 148 that surrounds the reduced diameter portion 62 of the upper mandrel 51. It is noted that a second dynamic seal 150 lies atop the dynamic seal 148. Dynamic seals 148,150 are stationary with housing 14 and slidingly engage cartridge mandrel 51, which rotates with the drill pipe. It will be understood by those of skill in the art that there are also fluid passages and static seals interconnected with the dynamic seal 150 as well as fluid inlet and outlet ports. Because these static seals and passages lie outside of the plane of the drawing in FIGS. 1A and 1B, they are not illustrated there. Nonetheless, these components have substantially the same structure as the static seals 142, 144 and passages 146, 147 shown for dynamic seal 148. The dynamic seals 148, 150 are similar in construction and operation to the dynamic seals 94, 96 described earlier and are physically axially offset in location from the dynamic seals 94, 96.

In operation, a lubricating fluid, typically a hydraulic fluid, is pumped via hydraulic conduits (not shown) into the fluid inlet ports 16*a*, 16*b* during a drilling operation in which a drilling string passes through cartridge assembly 12. The hydraulic fluid is used to lubricate the dynamic seals 94, 96 and 148, 150 as the body 46 and sleeve 58 rotate within the cartridge housing 48. The hydraulic fluid pumped into the upper fluid inlet ports 16*a* is transmitted to dynamic seals 148, 150 via fluid inlet port 16*a*, static seal 142 and fluid passage 146. The hydraulic fluid lubricates each of these bearings for proper operation. Hydraulic fluid circulates from the rotating drilling head assembly 10 by passing through the fluid passage 147 and static seal 144 to outlet port 18*a*. Hydraulic fluid that is pumped into the lower fluid inlet port 16*b* is transmitted to dynamic seals 94, 96 via static seals 116, 118 and 120 and fluid passages 104, 106 and 108. The dynamic seals 94, 96 are lubricated, and spent fluid is returned via the fluid passages 110, 112 and static seals 122 and 124 to fluid outlet ports 18*b*.

The employment of a plurality of static seals that are angularly spaced about the circumference of the drilling head assembly 10 allows fluid to be passed inwardly toward the radial center of the drilling head assembly 10 at several different heights. However, only one or two changes in the external diameter for the cartridge housing 48 are required. These changes in diameter occur at the curved shoulders 40 and 42. At the same time, numerous fluid inlet ports and outlet ports may be accommodated. As FIG. 2 illustrates, five static seals are available on the radial body 92 for mating with inlet and outlet ports 16*b*, 18*b*. In addition, static seals are very resilient, and the cartridge 12 may be replaced numerous times without the fluid seals failing.

While the invention has been described with reference to a preferred embodiment, it should be apparent to those skilled in the art that it is not so limited, but is susceptible to various modifications and changes without departing from the scope of the invention.

What is claimed is:

1. A head assembly comprising:

an outer, generally cylindrical housing that defines a bore therewithin;

a cartridge assembly that is removably disposable within the bore of the outer housing and comprising:

a radially outer cartridge housing;

a radially inner cartridge body that is mounted within the outer cartridge housing for rotational movement therein;

a dynamic seal located on an inner radial portion of the cartridge housing to provide active lubrication for ease of rotatable movement by the cartridge body within the cartridge housing; and a fluid supply assembly for providing fluid to the dynamic seal for lubrication, the fluid supply assembly comprising:

a fluid inlet port disposed through the outer cylindrical housing for receiving lubricating fluid;

a fluid inlet passage disposed through the cartridge housing to receive lubricating fluid from the fluid inlet port and transmit it to the dynamic seal; and a first fluid inlet static seal located on the exterior radial surface of the cartridge housing to provide a mating seal between the fluid inlet port and the fluid inlet passage.

2. The head assembly of claim 1 further comprising a fluid outlet passage disposed through the cartridge housing to remove spent lubricating fluid.

3. The head assembly of claim 2 further comprising a first fluid outlet static seal located on the exterior radial surface of the cartridge housing.

4. The head assembly of claim 3 wherein the first fluid inlet static seal and first fluid outlet static seal are angularly spaced apart about the circumference of the cartridge housing.

5. The head assembly of claim 1 further comprising:

a second dynamic seal located on the inner radial surface of the cartridge housing to provide active lubrication for ease of rotation for the cartridge body within the cartridge housing, the second dynamic seal being axially offset from the first dynamic seal; and a second fluid inlet passage disposed through the cartridge housing to provide lubricating fluid to the second dynamic seal.

6. The head assembly of claim 5 further comprising a second fluid inlet static seal located on the exterior radial surface of the cartridge housing to provide a mating seal between the second fluid inlet passage and a fluid inlet port associated with the outer housing.

7. The head assembly of claim 1 wherein the first fluid inlet static seal comprises an axially compressible seal member.

8. The head assembly of claim 1 further comprising a retaining ring assembly to retain the cartridge body radially within the cartridge housing.

9. The head assembly of claim 1 further comprising a roller bearing disposed within the cartridge assembly to assist rotational movement of the cartridge body within the cartridge housing.

10. A cartridge housing for a cartridge assembly comprising:

a generally cylindrical cartridge housing body defining a bore for retaining therein a cartridge body;

a plurality of dynamic seals located along the bore of the housing to contact a cartridge body in a bearing relation and provide active lubrication thereto;

a plurality of fluid inlet passages defined within the cartridge housing to transmit fluid from the radial exterior of the cartridge housing to each of the dynamic seals; and a plurality of fluid inlet static seals located upon the radial exterior of the cartridge housing to form a fluid seal against an outer housing, each of said fluid inlet static seals being associated with one of said fluid inlet passages.

11. The cartridge housing of claim 10 wherein the fluid inlet static seals are located at approximately an equivalent lateral location upon the radial exterior of the cartridge housing body.

12. A cartridge housing for a cartridge assembly comprising:

a generally cylindrical cartridge housing body defining a bore for retaining therein a cartridge body;

a plurality of dynamic seals located along the bore of the housing to contact a cartridge body in a bearing relation and provide active lubrication thereto;

a plurality of fluid inlet passages defined within the cartridge housing to transmit fluid from the radial exterior of the cartridge housing to each of the dynamic seals;

a plurality of fluid inlet static seals located upon the radial exterior of the cartridge housing to form a fluid seal against an outer housing, each of said fluid inlet static seals being associated with one of said fluid inlet passages; wherein the fluid inlet static seals are located at approximately an equivalent lateral upon the radial exterior of the cartridge housing body; and wherein the fluid inlet static seals are located upon an enlarged diameter portion of the cartridge housing body.

13. The cartridge housing of claim 12 further comprising a plurality of fluid outlet passages disposed within the cartridge housing body.

14. The cartridge housing of claim 12 further comprising a plurality of fluid outlet static seals located on the outer radial surface of the cartridge housing body, each of the fluid outlet static seals being associated with one of said fluid outlet passages and adapted to form a fluid seal against an outer housing.

15. A drilling head assembly for retaining a drill pipe, comprising:

an outer main housing;

a cartridge assembly, seated within the main housing, for gripping a portion of a drillstring for rotation of the drill string with respect to the main housing, the cartridge assembly comprising:

a radially outer stationary cartridge housing defining a bore therewithin;

a radially inner cartridge body rotatably disposed within the cartridge housing and having a selectively energizable gripping member for gripping a portion of a drill string; and a static seal within the cartridge housing for establishing a fluid seal and point of fluid transfer between the outer main housing and the cartridge housing.

16. The drilling head assembly of claim 15 further comprising at least one dynamic seal for providing active lubrication for ease of rotatable movement by the cartridge body within the cartridge housing.

17. The drilling head assembly of claim 16 further comprising a fluid inlet passage associated with the static seal to receive lubricating fluid therefrom and transmit it to said dynamic seal.

18. A drilling head assembly for retaining a drill pipe, comprising:

an outer main housing;

a cartridge assembly, seated within the main housing, for gripping a portion of a drillstring for rotation of the drill string with respect to the main housing, the cartridge assembly comprising:

a radially outer stationary cartridge housing defining a bore therewithin;

a radially inner cartridge body rotatably disposed within the cartridge housing and having a selectively energizable gripping member for gripping a portion of a drill string;

a static seal within the cartridge housing for establishing a fluid seal and point of fluid transfer between the outer main housing and the cartridge housing;

at least one dynamic seal for providing active lubrication for ease of rotatable movement by the cartridge body within the cartridge housing;

a fluid inlet passage associated with the static seal to receive lubricating fluid therefrom and transmit it to said dynamic seal; and wherein the dynamic seal comprises an annular bearing member having a plurality of fluid apertures disposed therethrough.

19. The drilling head assembly of claim 18 further comprising a fluid outlet passage associated with the static seal to transmit lubricating fluid thereto from said dynamic seal.

* * * * *